US005860192A

United States Patent [19]

Chung

[11] Patent Number: 5,860,192

[45] Date of Patent: Jan. 19, 1999

[54] PULL TAB MOUNTING ARRANGEMENT FOR A ZIPPER

[75] Inventor: Roger C. Y. Chung, Taipei Hsien, Taiwan

[73] Assignee: Keen Ching Industrial Co., Ltd., Taipei, Taiwan

[21] Appl. No.: 88,120

[22] Filed: Jun. 1, 1998

[30] Foreign Application Priority Data

Sep. 26, 1997 [TW] Taiwan ..... 86216428

[51] Int. Cl.[6] ..... A44B 19/26

[52] U.S. Cl. ..... 24/429; 24/431

[58] Field of Search ..... 24/429, 430, 415, 24/300–302, 265 EE, 265 EC, 115 R, 115 G, 115 W, 122.3, 122.6, 130, 136 R, 136 L

[56] References Cited

U.S. PATENT DOCUMENTS 3,641,634 2/1972 Asai ..... 24/429
5,347,692 9/1994 Ebata ..... 24/429
5,416,951 5/1995 Keyai et al. ..... 24/429 X
5,535,491 7/1996 Allport ..... 24/429

*Primary Examiner*—Anthony Knight
*Assistant Examiner*—Robert J. Sandy
*Attorney, Agent, or Firm*—Bacon & Thomas, PLLC

[57] ABSTRACT

A pull tab mounting arrangement includes a pull tab, and a coupling device coupled to a slide for a zipper to hold the pull tab, the coupling device has a substantially U-shaped spring wire rod at one end hung on a hanging hole on the slide, and a slotted bottom extension strip coupled to a split ring at one end of the pull tab, the U-shaped spring wire rod having one end pivoted to the body of the coupling device by a pivot pin, and an opposite end terminating in a retainer tip detachably forced by the spring power of the U-shaped spring wire rod into engagement with a retaining hole on the body of the coupling device.

5 Claims, 6 Drawing Sheets

PULL TAB MOUNTING ARRANGEMENT FOR A ZIPPER

BACKGROUND OF THE INVENTION (a) Field of the Invention:

The present invention relates to zippers, and more specifically to a pull tab mounting arrangement for a zipper which uses a coupling device to detachably couple a pull tab to the slide of a zipper.

(b) Description of the Prior Art:

A regular zipper is generally comprised of two rows of interlocking metal or plastic teeth that may be closed or separated by a sliding device. The sliding device is comprised of a slide, and a pull tab coupled to the slide. Because the slide and the pull tab are not detachable, the user cannot replace the pull tab with a different design.

SUMMARY OF THE INVENTION

It is one object of the present invention to provide a pull tab mounting arrangement for a zipper which enables the user to change the pull tab with a different design. It is another object of the present invention to provide a pull tab mounting arrangement for a zipper which uses a coupling device to detachably couple a pull tab to the slide of a zipper. According to one embodiment of the present invention, the coupling device comprises a U-shaped shackle made from a spring wire rod for hanging on a hanging hole at the slide and a hanging hole for holding the pull tab, the pull tab has a split ring hung on the hanging hole of said coupling device.

DETAILED DESCRIPTION OF THE PREFERRED EMBODIMENT

Figure 1:
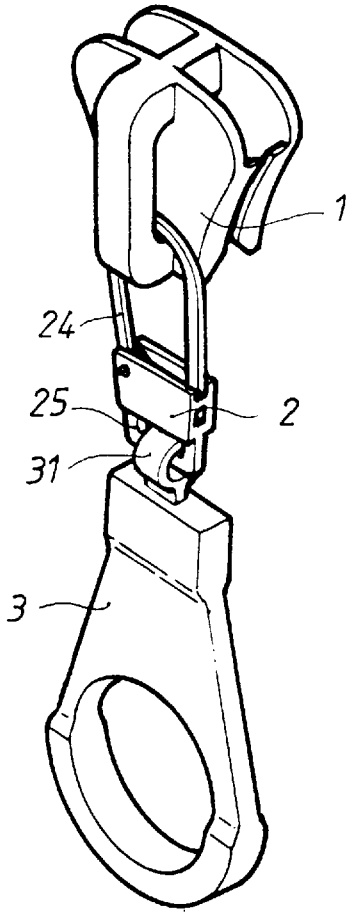
FIG. 1 is a perspective view of the present invention, showing the coupling device hung on the slide, the pull tab coupled to the coupling device.
Figure 2:
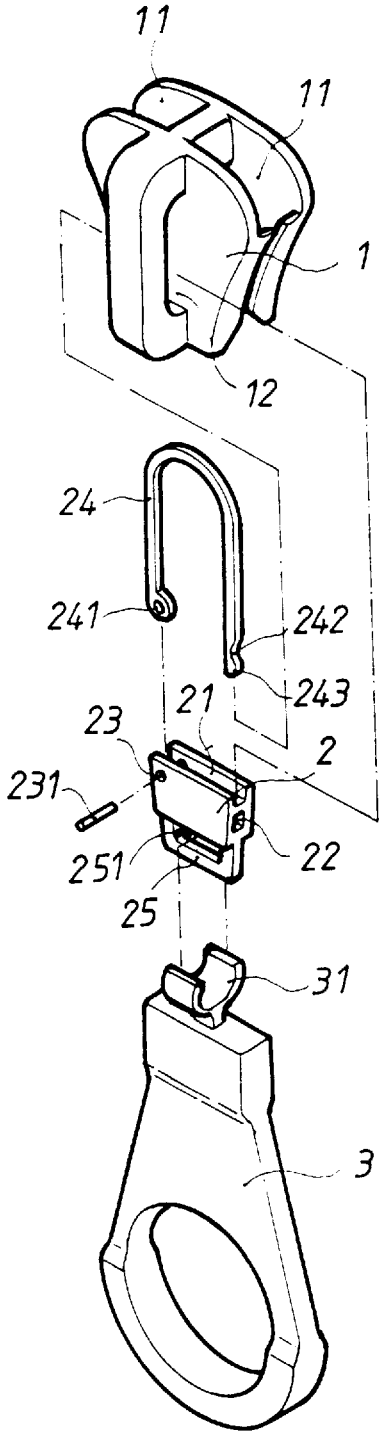
FIG. 2 is an exploded view of FIG. 1.
Figure 3:
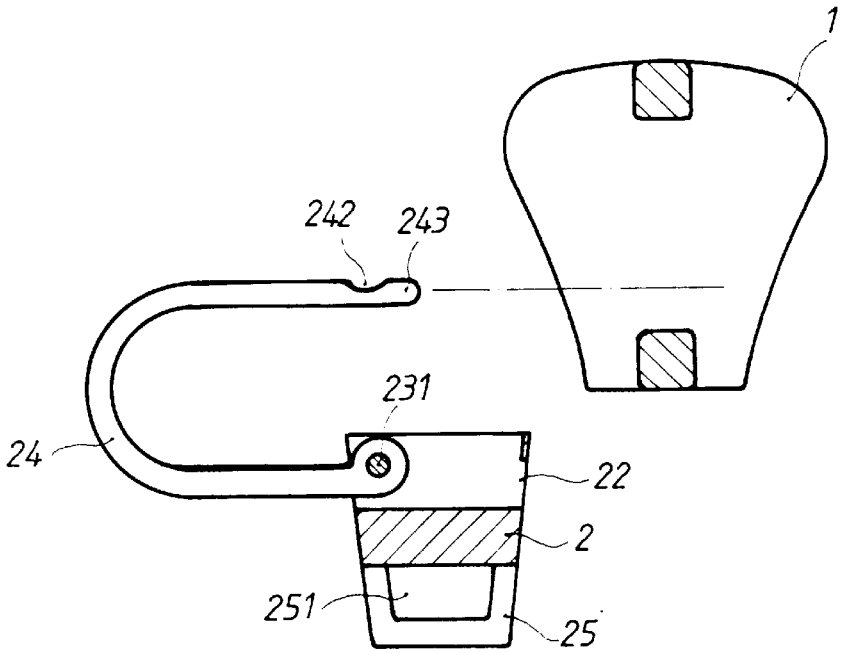
FIG. 3 is a schematic drawing showing the connection between the slide and the coupling device (before installation).
Figure 4:
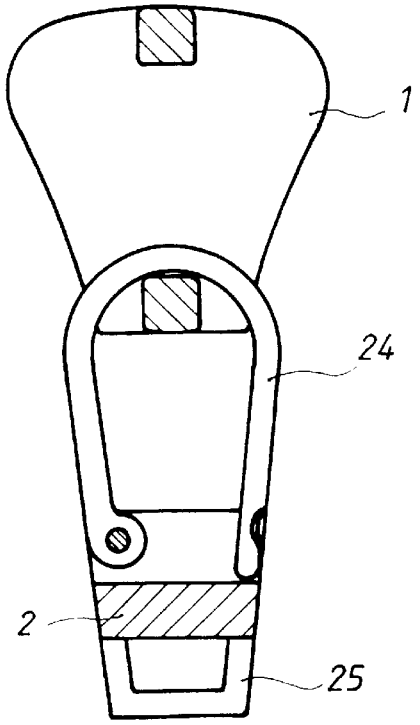
FIG. 4 is a schematic drawing showing the connection between the slide and the coupling device (after installation).

Referring to FIGS. 1 and 2, a pull tab mounting arrangement in accordance with the present invention is generally comprised of a pull tab 3, and a coupling device 2 for coupling the pull tab 3 to a slide 1.

The slide 1 comprises two sliding ways 11 bilaterally disposed on the inside and adapted to receive teeth of the zipper tapes, and a hanging hole 12 at the front side thereof.

The coupling device 2 comprises a substantially U-shaped spring wire rod 24 hung on the hanging hole 12 of the slide 1 and fastened to the body thereof. The body of the coupling device 2 comprises a top open chamber 21, a retaining hole 22 disposed in X-axis direction at one side in communication with the top open chamber 21, a pivot hole 23 disposed in Y-axis direction and intersected with the top open chamber 21 remote from the retaining hole 22, a bottom extension strip 25, and an elongated coupling hole 251 at the bottom extension strip 25. The U-shaped spring wire rod 24 is inserted through the hanging hole 12 on the slide 1, having a pivot hole 241 at one end connected to the pivot hole 23 on the body of the coupling device 2 by a pivot pin 231, a retainer tip 243 at an opposite end, and a notch 242 close to the retainer tip 243. The pull tab 3 comprises a split ring 31 integral with the head thereof. Further, the pull tab 3 can have any of a variety of designs.

Figure 5:
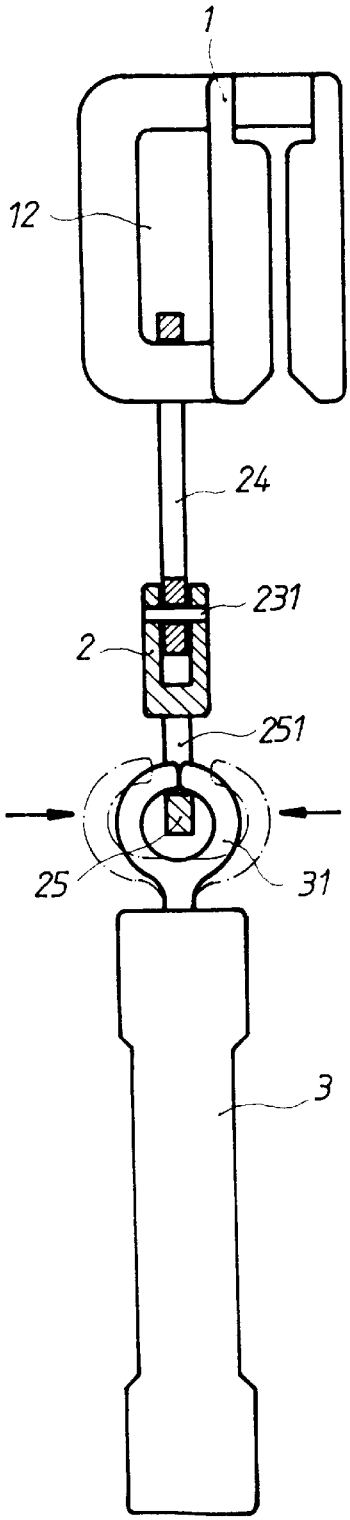
FIG. 5 is a schematic drawing showing the split ring of the pull tab hung on the hanging hole on the bottom extension strip of the coupling device and fixed.
Figure 8:
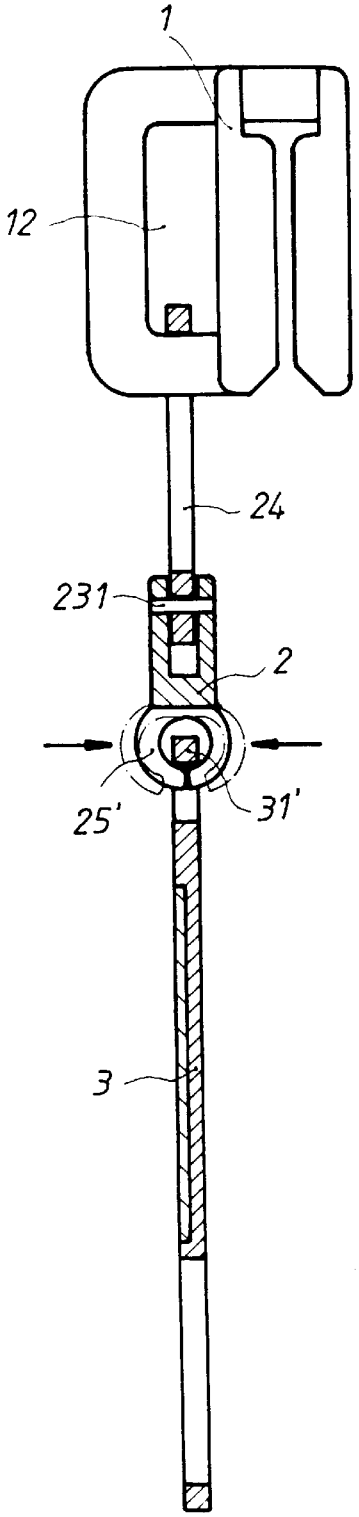
FIG. 8 is a schematic drawing of the alternate form of the present invention, showing the split ring of the coupling device hung on the hanging ring of the pull tab and fixed.
Figure 6:
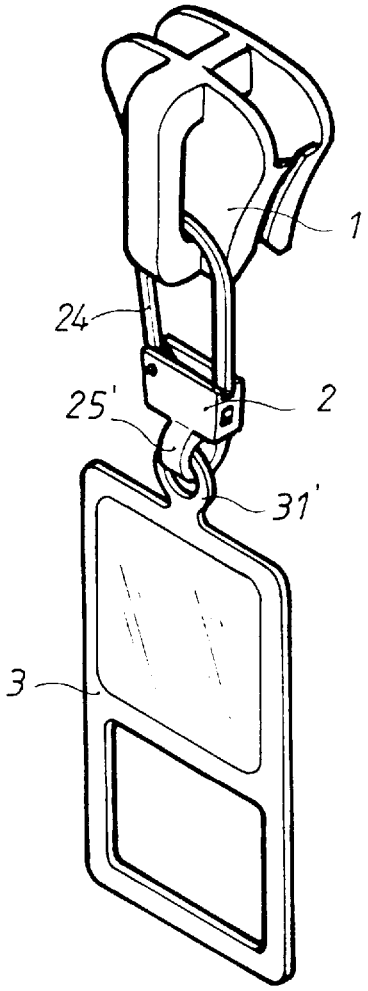
FIG. 6 is a perspective view of an alternate form of the present invention.
Figure 7:
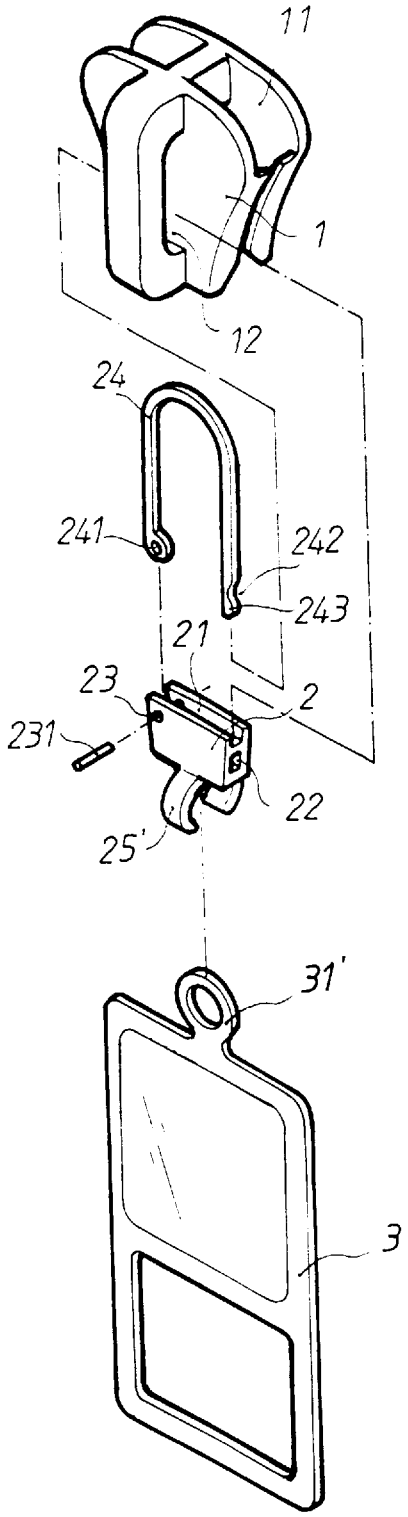
FIG. 7 is an exploded view of FIG. 6.

Referring to FIGS. from 3 to 5, after the U-shaped spring wire rod 24 has been inserted through the hanging hole 12 on the slide 1, the pivot hole 241 of the U-shaped spring wire rod 24 is connected to the pivot hole 23 on the body of the coupling device 2 by the pivot pin 231, and then the other end of the U-shaped spring wire rod 24 is inserted into the top open chamber 21, enabling the retainer tip 243 of the U-shaped spring wire rod 24 to be forced by the spring power of the U-shaped spring wire rod 24 into engagement with the retaining hole 22 on the body of the coupling device 2, and therefore the coupling device 2 and the slide 1 are coupled together. The split ring 31 of the pull tab 3 is coupled to the elongated coupling hole 251 at the bottom extension strip 25. After coupling, the split ring 31 of the pull tab 3 is fixed with a tool to close its split, and therefore the split ring 31 of the pull tab 3 and the bottom extension strip 25 of the coupling device 2 are secured together (see FIG. 5). When the U-shaped spring wire rod 24 is squeezed inwards with the hand, the retainer tip 243 is disengaged from the retaining hole 22, allowing the U-shaped spring wire rod 24 to be disconnected from or coupled to the hanging hole 12 on the slide 1.

FIGS. from 6 to 8 show an alternate form of the present invention. According to this alternate form, the pull tab 3 has a hanging ring 31', and the body of the coupling device 2 has a split ring 25' coupled to the hanging ring 31'. After coupling, the split ring 25' is fixed with a tool to close its split.

It is to be understood that the drawings are designed for purposes of illustration only, and are not intended as a definition of the limits and scope of the invention disclosed.

What the invention claims is:

1. A pull tab mounting arrangement comprising a pull tab, and a coupling device coupled to a slide for a zipper to hold said pull tab, wherein said coupling device comprises a body and a substantially U-shaped spring wire rod connected to said body for hanging on a hanging hole on the slide of the zipper, said body comprising a top open chamber, a retaining hole disposed in X-axis direction at one side in communication with said top open chamber, a pivot hole disposed in Y-axis direction and intersected with said top open chamber remote from said retaining hole, a bottom coupling portion coupled to said pull tab, said U-shaped spring wire rod comprising a pivot hole at one end connected to the pivot hole on the body of said coupling device by a pivot pin, and a retainer tip at an opposite end inserted into the top open chamber of said body and forced by the spring power of the material of said U-shaped spring wire rod into engagement with the retaining hole on said body; said pull tab has a coupling portion coupled to the coupling portion of said body of said coupling device.

2. The pull tab mounting arrangement of claim 1 wherein the coupling portion of the body of said coupling device is a bottom extension strip integral with the body of said coupling device, said bottom extension strip defining an elongated coupling hole for holding said pull tab.

3. The pull tab mounting arrangement of claim 2 wherein the coupling portion of said pull tab is a split ring at one end coupled to the coupling hole on said bottom extension strip of said coupling device.

4. The pull tab mounting arrangement of claim 1 wherein the coupling portion of the body of said coupling device is a split ring coupled to the coupling portion of said pull tab.

5. The pull tab mounting arrangement of claim 4 wherein the coupling portion of said pull tab is a hanging ring integral with said pull tab for hanging the hanging ring of the body of said coupling device.

* * * * *